US005514333A

United States Patent [19]

Fujiwara et al.

[11] Patent Number: 5,514,333

[45] Date of Patent: May 7, 1996

[54] HIGH STRENGTH AND HIGH DUCTILITY TIAL-BASED INTERMETALLIC COMPOUND AND PROCESS FOR PRODUCING THE SAME

[75] Inventors: Yoshiya Fujiwara; Toshio Tokune, both of Wako, Japan

[73] Assignee: Honda Giken Kogyo Kabushiki Kaisha, Tokyo, Japan

[21] Appl. No.: 273,536

[22] Filed: Jul. 11, 1994

[30] Foreign Application Priority Data

Jul. 14, 1993 [JP] Japan ..... 5-174476
Dec. 13, 1993 [JP] Japan ..... 5-311547

[51] Int. Cl.[6] ..... C22C 14/00

[52] U.S. Cl. ..... 420/420; 420/418

[58] Field of Search ..... 420/418, 420

[56] References Cited

U.S. PATENT DOCUMENTS

| | | | |
|---|---|---|---|
| H, 887 | 2/1991 | Venkataraman et al. | 420/420 |
| 4,842,820 | 5/1992 | Huang | 420/418 |
| 4,857,268 | 8/1989 | Huang | 420/418 |
| 4,897,127 | 1/1990 | Huang | 420/420 |
| 5,205,984 | 4/1993 | Rowe | 420/420 |

FOREIGN PATENT DOCUMENTS

| | | |
|---|---|---|
| 0477559 | 4/1992 | European Pat. Off. . |
| 0495454 | 7/1992 | European Pat. Off. . |
| 0581204 | 7/1992 | European Pat. Off. . |
| 1298127 | 12/1989 | Japan . |

OTHER PUBLICATIONS

English language Abstract of JP 1–298127 Dec. 1989.

"Micromechanics of Shear Ligament Toughening", K. Chan, Sep. 1991–Metallurgical Transactions.

*Primary Examiner*—Scott Kastler
*Attorney, Agent, or Firm*—Lyon & Lyon

[57] ABSTRACT

A high strength and high ductility TiAl-based intermetallic compound includes a content of aluminum in a range represented by 42.0 atom %≦Al≦50.0 atom %, a content of vanadium in a range represented by 1.0 atom %≦V≦3.0 atom %, a content of niobium in a range represented by 1.0 atom %≦Nb≦10.0 atom %, a content of boron in a range represented by 0.03 atom %≦B≦2.2 atom %, and the balance of titanium and unavoidable impurities. A product of the TiAl-based intermetallic compound is formed by only casting or casting followed by a homogenizing thermal treatment.

3 Claims, 4 Drawing Sheets

HIGH STRENGTH AND HIGH DUCTILITY TIAL-BASED INTERMETALLIC COMPOUND AND PROCESS FOR PRODUCING THE SAME

BACKGROUND OF THE INVENTION

1. Field of the Invention

The present invention relates to a high strength and high ductility TiAl-based intermetallic compound and to a process for producing the same.

2. Description of the Prior Art

TiAl-based intermetallic compound is excellent as a component material for a rotating part in an engine because it is lightweight and has an excellent heat-resistance. However, normally it is very brittle and hence, an improvement in this respect is desired.

In order to provide both the strength and the ductility at ambient temperature, various TiAl-based intermetallic compounds have been conventionally proposed. For example, there are known TiAl-based intermetallic compounds produced by subjecting an ingot containing niobium and boron, or vanadium and boron added thereto to an isothermal forging (see Japanese Patent Application Laid-Open No. 298127/89).

Such a prior art TiAl-based intermetallic compound has relatively high ductility and strength at ambient temperature, because it is produced through isothermal forging at a high temperature, but such compounds have not yet been put into practical use. In addition, the prior art TiAl-based intermetallic compounds suffer from a problem that it is absolutely necessary to conduct the isothermal forging at a high temperature after the casting, thereby bringing about increases in the number of manufacturing steps and in equipment cost. Therefore, an increase in manufacturing cost of the Tial-based intermetallic compound is inevitable, and moreover, the degree of freedom of the shape of the products made from the intermetallic compounds is low.

SUMMARY OF THE INVENTION

It is an object of the present invention to provide a TiAl-based intermetallic compound of the type described above, wherein, by specifying the type and concentration of added elements, a high level of both strength and ductility at ambient temperature can be provided either by only casting or by a homogenizing thermal treatment after the casting. As a result, a reduction in the manufacturing cost and an increase in the degree of freedom of the produceable shapes are realized.

To achieve the above object, according to the present invention, there is provided a high strength and high ductility TiAl-based intermetallic compound comprising a content of aluminum (Al) in a range represented by 42.0 atom $\% \leqq Al \leqq 50.0$ atom %, a content of vanadium (V) in a range represented by 1.0 atom $\% \leqq V \leqq 3.0$ atom %, a content of niobium (Nb) in a range represented by 1.0 atom $\% \leqq Nb \leqq 10.0$ atom %, a content of boron (B) in a range represented by 0.03 atom $\% \leqq B \leqq 2.2$ atom %, and the balance of titanium and unavoidable impurities.

Another object of this invention is to provide such a TiAl-based intermetallic compound with the aluminum content in the above range, whereby the metallographic texture of the TiAl-based intermetallic compound, after the casting or after a homogenizing thermal treatment following the casting, is composed of a $Ll_0$ type $\gamma$ phase (TiAl phase), an $\alpha$ 2 phase ($Ti_3Al$ phase) and a very small amount of an intermetallic compound phase. In this case, the main phase is the $Ll_0$ type $\gamma$ phase, and the volume fraction Vf thereof reaches a value equal to or more than 80% ($Vf \geqq 80\%$). Such a metallographic texture of a two phase structure is effective for enhancing the strength and ductility at ambient temperature for the TiAl-based intermetallic compound.

Another object of this invention is to provide such a TiAl-based intermetallic compound with vanadium, niobium and boron all included with their contents in the above ranges, whereby the metallographic texture of the TiAl-based intermetallic compound, after the casting or after the homogenizing thermal treatment following the casting, assumes a finely divided form and has a relatively high hardness. The ambient temperature strength of the TiAl-based intermetallic compound is considerably enhanced by such effects of aluminum as well as vanadium, niobium and boron.

Another object of this invention is to provide such a TiAl-based intermetallic compound by only casting or by a homogenizing thermal treatment following the casting. This provides advantages of a relatively low manufacturing cost and a high degree of freedom of the produceable shapes of the products made of the TiAl-based intermetallic compound.

The above and other objects, features and advantages of the invention will become apparent from the following description of a preferred embodiment taken in conjunction with the accompanying drawings.

DESCRIPTION OF THE PREFERRED EMBODIMENT

Figure 1:
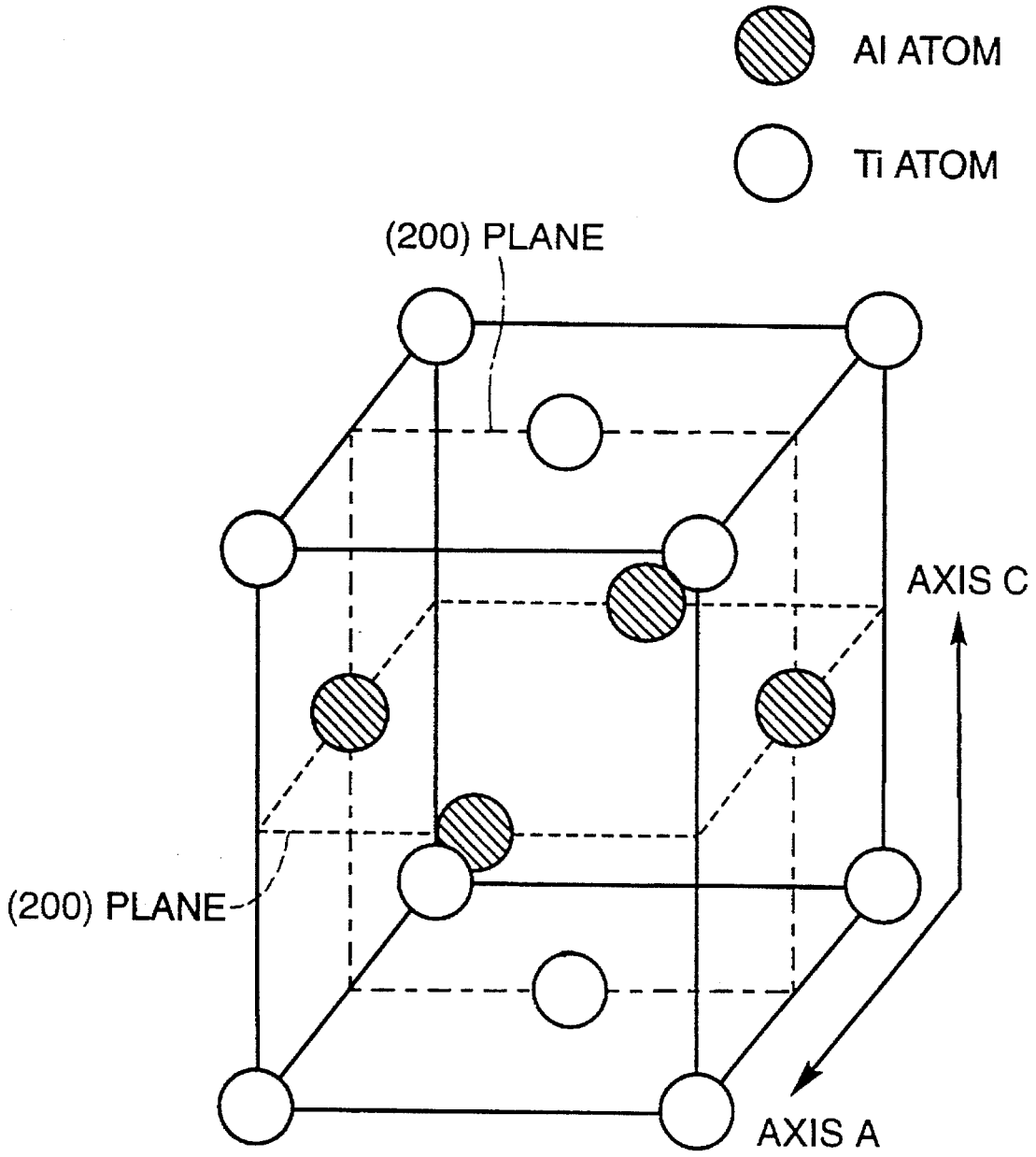
FIG. 1 is a perspective view illustrating a crystal structure of an $Ll_0$ type $\gamma$ phase.

Blanks of various compositions were prepared which included a content of aluminum (Al) in a range represented by 42.0 atom $\% \leqq Al \leqq 50.0$ atom %, a content of vanadium (V) in a range represented by 1.0 atom $\% \leqq V \leqq 3.0$ atom %, a content of niobium (Nb) in a range represented by 1.0 atom $\% \leqq Nb \leqq 10.0$ atom %, a content of boron (B) in a range represented by 0.03 atom $\% \leqq B \leqq 2.2$ atom %, and the balance of titanium and unavoidable impurities. The blanks were melted under an argon atmosphere by use of a non-consumable arc melting furnace. And the molten metals were poured into a water-cooled copper casting mold to produce ingots having a diameter of 14 mm and a length of 100 mm.

Thereafter, the ingots were subjected to a homogenizing thermal treatment under conditions of 1,200° C. for 3 hours in a vacuum to provide various TiAl-based intermetallic compounds, identified by ($A_1$) to ($A_{14}$), as examples of embodiments of the present invention.

Table 1 shows the compositions and the volume fractions Vf of $Ll_0$ type γ phases for the TiAl-based intermetallic compounds ($A_1$) to ($A_{14}$), and for two TiAl-based intermetallic compounds ($A_{01}$) and ($A_{02}$) which were produced without the homogenizing thermal treatment. The TiAl-based intermetallic compounds ($A_{01}$) and ($A_{02}$) correspond in content to the ingots for the TiAl-based intermetallic compounds ($A_4$) and ($A_5$). Unavoidable impurities are contained in the "balance" in the Ti column in Table 1.

TABLE 1

| TiA1-based intermetallic compound | Chemical constituents (atom %) | | | | | $Ll_0$ type γ phase |
|---|---|---|---|---|---|---|
| | A1 | V | Nb | B | Ti | Vf (%) |
| ($A_1$) | 42.0 | 3.0 | 2.0 | 1.0 | Balance | 80 |
| ($A_2$) | 45.0 | 1.0 | 1.0 | 0.5 | Balance | 84 |
| ($A_3$) | 45.0 | 1.0 | 3.0 | 1.0 | Balance | 85 |
| ($A_4$) | 45.0 | 2.0 | 2.0 | 1.3 | Balance | 86 |
| ($A_5$) | 45.0 | 2.0 | 3.0 | 1.5 | Balance | 85 |
| ($A_6$) | 45.0 | 3.0 | 2.0 | 2.0 | Balance | 85 |
| ($A_7$) | 49.0 | 3.0 | 2.0 | 1.0 | Balance | 94 |
| ($A_8$) | 46.0 | 1.0 | 10.0 | 0.7 | Balance | 85 |
| ($A_9$) | 45.0 | 2.0 | 8.0 | 1.2 | Balance | 83 |
| ($A_{10}$) | 50.0 | 1.5 | 2.0 | 1.0 | Balance | 98 |
| ($A_{11}$) | 46.0 | 2.0 | 2.0 | 0.3 | Balance | 90 |
| ($A_{12}$) | 46.0 | 2.0 | 2.0 | 2.2 | Balance | 91 |
| ($A_{13}$) | 45.0 | 2.0 | 2.0 | 0.03 | Balance | 90 |
| ($A_{14}$) | 46.0 | 2.0 | 2.0 | 0.1 | Balance | 90 |
| ($A_{01}$) | 45.0 | 2.0 | 2.0 | 1.3 | Balance | 82 |
| ($A_{02}$) | 45.0 | 2.0 | 3.0 | 1.5 | Balance | 81 |

For comparison, blanks of various compositions including aluminum as a requisite chemical constituent, vanadium, chromium, niobium and boron as optional chemical constituents, and the balance of Ti and unavoidable impurities were prepared and then subjected sequentially to melting, casting and homogenizing thermal treatments to provide various TiAl-based intermetallic compounds ($B_1$) to ($B_6$) as comparative examples. The ingots of TiAl-based intermetallic compounds ($B_1$) to ($B_6$) had the same size as those in the examples of the embodiment, i.e., a diameter of 14 mm and a length of 100 mm.

Table 2 shows the compositions and the volume fractions Vf of $Ll_0$ type γ phases for the TiAl-based intermetallic compounds ($B_1$) to ($B_6$). Unavoidable impurities are contained in the "balance" in the Ti column in Table 2.

TABLE 2

| TiA1-based intermetallic compound | Chemical constituents (atom %) | | | | | | $Ll_0$ type γ phase Vf (%) |
|---|---|---|---|---|---|---|---|
| | A1 | V | Cr | Nb | B | Ti | |
| ($B_1$) | 50.0 | — | — | — | — | Balance | 98 |
| ($B_2$) | 48.0 | 2.5 | — | — | — | Balance | 90 |
| ($B_3$) | 48.0 | — | 2.0 | 4.0 | 1.0 | Balance | 88 |
| ($B_4$) | 48.0 | — | — | 2.0 | — | Balance | 92 |
| ($B_5$) | 48.0 | 2.0 | — | — | 0.5 | Balance | 89 |
| ($B_6$) | 48.0 | — | — | 2.5 | 1.0 | Balance | 92 |

The TiAl-based intermetallic compounds ($A_1$) to ($A_{14}$), ($A_{01}$), ($A_{02}$), ($B_1$) to ($B_6$) were subjected to an X-ray diffraction to determine a ratio c/a between lattice constants "a" and "c" in a crystal structure of $Ll_0$ type γ phase.

The crystal structure of $Ll_0$ γ phase is shown in FIG. 1 and is a face-centered tetragonal system. The ratio c/a is determined from a ratio $d_2/d_1$ between a spacing $d_1$ of planes specified by a reflection from a plane (200) indicating the lattice constant "a" on an axis "a", and a spacing $d_2$ of planes specified by a reflection from a plane (002) indicating the lattice constant "c" on an axis "c" in an X-ray diffraction pattern.

Test pieces were fabricated according to an ASTM E8 Specification from the TiAl-based intermetallic compounds ($A_1$) to ($A_{14}$), ($A_{01}$), ($A_{02}$) and ($B_1$) to ($B_6$). These test pieces were used to conduct a tensile test under a condition of a rate of strain of 0.3%/min (constant) at ambient temperature in the atmosphere to determine the tensile strength and the elongation at ambient temperature for the TiAl-based intermetallic compounds ($A_1$) to ($A_{14}$), ($A_{01}$), ($A_{02}$), and ($B_1$) to ($B_6$).

Table 3 shows the ratio c/a between both the lattice constants and the tensile strength and elongation at ambient temperature for the TiAl-based intermetallic compounds ($A_1$) to ($A_{14}$), ($A_{01}$), ($A_{02}$) and ($B_1$) to ($B_6$).

TABLE 3

| TiA-1 based intermetallic compound | Ratio c/a between lattice constants | Tensile strength at ambient temperature (MPa) | Elongation at ambient temperature (%) |
|---|---|---|---|
| ($A_1$) | 1.012 | 661 | 1.5 |
| ($A_2$) | 1.012 | 654 | 1.3 |
| ($A_3$) | 1.012 | 670 | 1.4 |
| ($A_4$) | 1.011 | 685 | 2.0 |
| ($A_5$) | 1.012 | 671 | 1.9 |
| ($A_6$) | 1.013 | 653 | 1.5 |
| ($A_7$) | 1.012 | 613 | 1.3 |
| ($A_8$) | 1.013 | 601 | 1.0 |
| ($A_9$) | 1.012 | 650 | 1.2 |
| ($A_{10}$) | 1.014 | 603 | 1.0 |
| ($A_{11}$) | 1.012 | 672 | 1.2 |
| ($A_{12}$) | 1.012 | 668 | 1.5 |
| ($A_{13}$) | 1.012 | 670 | 1.5 |
| ($A_{14}$) | 1.012 | 666 | 1.8 |
| ($A_{01}$) | 1.011 | 665 | 1.8 |
| ($A_{02}$) | 1.012 | 659 | 1.6 |
| ($B_1$) | 1.021 | 421 | 0.3 |
| ($B_2$) | 1.019 | 525 | 0.6 |
| ($B_3$) | 1.016 | 610 | 0.7 |
| ($B_4$) | 1.017 | 477 | 0.5 |
| ($B_5$) | 1.017 | 523 | 0.7 |
| ($B_6$) | 1.017 | 575 | 0.6 |

Figure 2:
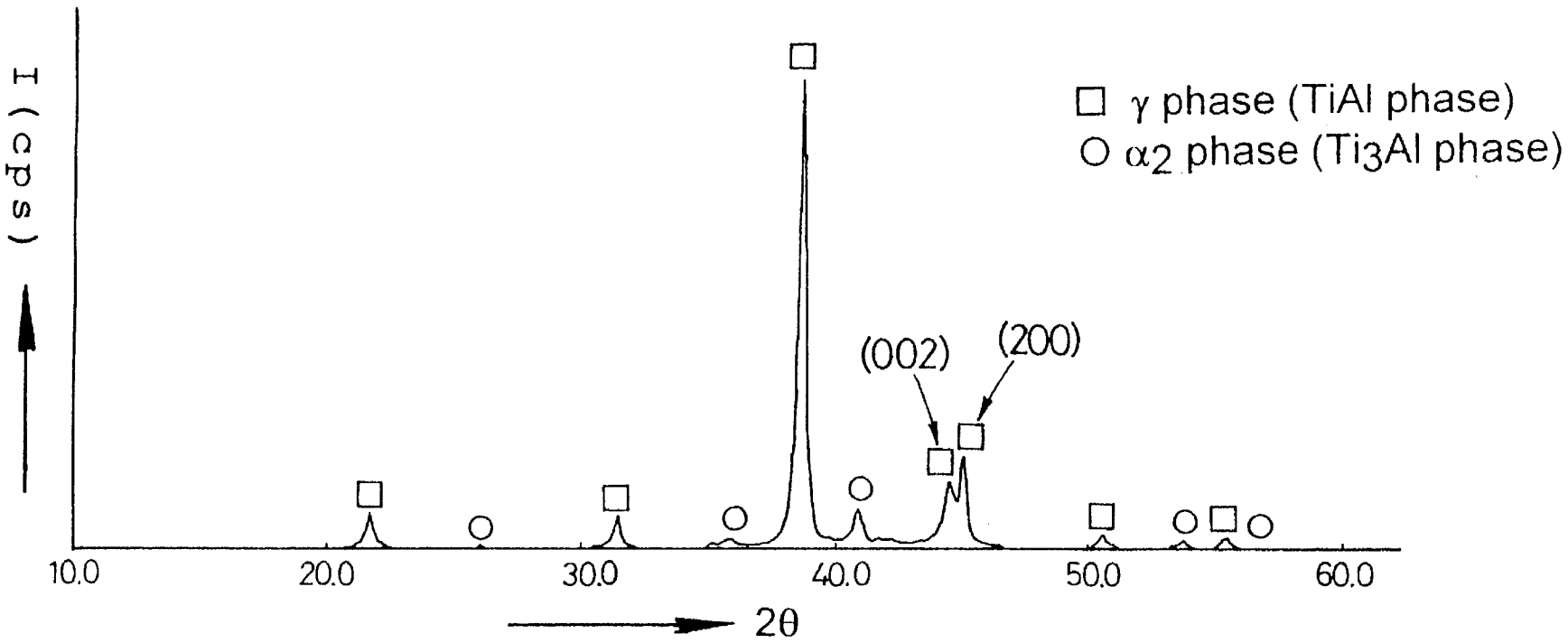
FIG. 2 is an X-ray diffraction pattern for a TiAl-based intermetallic compound of this invention.

FIG. 2 shows an X-ray diffraction pattern for the TiAl-based intermetallic compound ($A_4$), wherein peaks of reflection from the (002) and (200) planes are observed.

Figure 3:
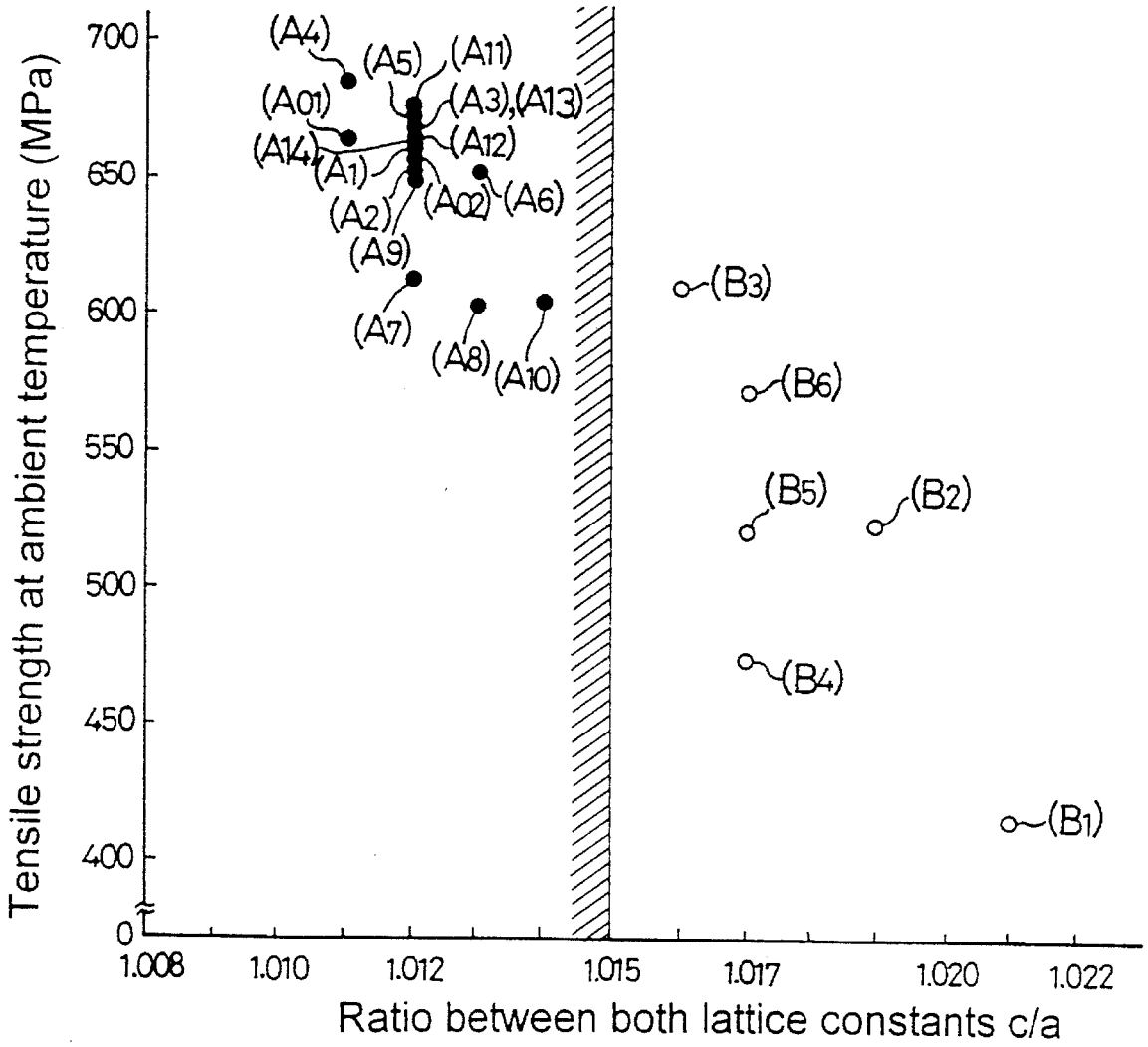
FIG. 3 is a graph illustrating the relationship between the tensile strength at ambient temperature and the ratio c/a between both lattice constants of examples of compounds of this invention and comparative examples.
Figure 4:
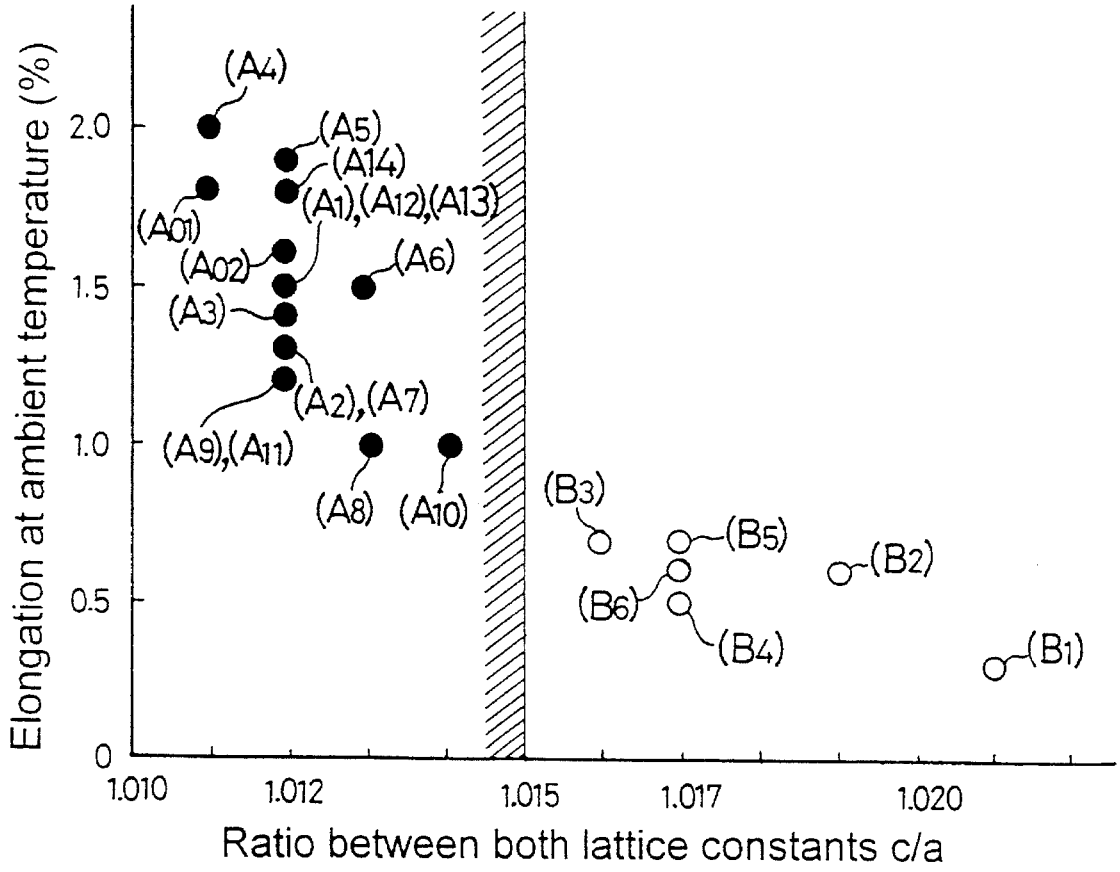
FIG. 4 is a graph illustrating the relationship between the elongation at ambient temperature and the ratio c/a between both lattice constants of examples of compounds of this invention and comparative examples.

FIG. 3 is a graph of the values taken from Table 3 and illustrating the relationship between the tensile strength at ambient temperature and the ratio c/a between both the lattice constants. FIG. 4 is a graph of the values taken from Table 3 and illustrating the relationship between the elongation at ambient temperature and the ratio c/a between both the lattice constants.

The TiAl-based intermetallic compounds ($A_1$) to ($A_{14}$), ($A_{01}$) and ($A_{02}$) as the examples of embodiments of the invention include the chemical constituents in concentrations set within the above-described range. As apparent from Tables 1 and 3 and FIGS. 3 and 4, each of the compounds has an excellent tensile strength and an excellent elongation at ambient temperature, as compared with the TiAl-based intermetallic compounds ($B_1$) to ($B_6$) as the comparative examples, due to the volume fraction Vf of $Ll_0$ type γ phases equal to or more than 80% (Vf≧80%) and due to the lattice constants being approximately equal to each other, i.e. c/a approaches 1.0. Therefore, it is possible to provide high levels of both strength and ductility at ambient temperature.

Each of the TiAl-based intermetallic compounds ($A_{01}$) and ($A_{02}$) produced by only casting have slightly inferior tensile strength and elongation at ambient temperature, as compared with the TiAl-based intermetallic compounds ($A_4$) and ($A_5$) having the same composition and produced with the homogenizing thermal treatment, but have the substantially same ratio c/a between both the lattice constants.

In addition, it has been ascertained from various experiments that the ratio c/a between both the constants is preferably equal to or less than 1.015 (c/a≦1.015), because, if the ratio c/a exceeds 1.015, the isotropy of TiAl—γ is lost and both the strength and ductility are lowered. In this case, the ratio c/a between both the constants cannot be less than 1.0 (c/a<1.0).

By comparison of the TiAl-based intermetallic compound ($B_1$) with the TiAl-based intermetallic compounds ($B_2$) and ($B_4$) in Tables 2 and 3 and FIG. 4, it can be seen that the ratio c/a between the lattice constants is reduced, and the elongation at ambient temperature is slightly increased, due to the addition of only vanadium or niobium.

The crystal structure of $Ll_0$ type γ phase is of a face-centered tetragonal system, and between both lattice constants "a" and "c", a relation a<c is established, that can result in problems of a low isotropy of the crystal structure and a reduced ambient temperature ductility of the TiAl-based intermetallic compound. However, with the addition of vanadium, niobium and boron in their respective contents set forth above, both the lattice constants a and c in the $Ll_0$ type γ phase crystal structure can be approximated to each other, thereby improving the isotropy of the $Ll_0$ type γ phase crystal structure. Further, because the metallographic texture is formed into the two-phase structure, the ambient temperature ductility of the TiAl-based intermetallic compound can considerably be enhanced.

However, if the aluminum content is less than 42.0 atom %, the volume fraction of $\alpha_2$ phase is too high, thereby bringing about a reduction in ambient temperature ductility of the TiAl-based intermetallic compound. On the other hand, if the aluminum content is more than 50.0 atom %, the volume fraction of $\alpha_2$ phase is too low, thereby bringing about a reduction in ambient temperature strength of the TiAl-based intermetallic compound.

If the vanadium, niobium and boron contents are less than 1.0 atom %, less than 1.0 atom % and less than 0.03 atom %, respectively, it is impossible to achieve the approximation of both the lattice constants a and c to each other and hence, the considerable enhancement in ambient temperature ductility of the TiAl-based intermetallic compound cannot be achieved. If vanadium and niobium are added alone, the lattice constants are approximated to each other to a certain extent, but such extent is small, resulting in a low degree of enhancement in ambient temperature ductility of the TiAl-based intermetallic compound.

On the other hand, if the vanadium content is more than 3.0 atom %, the TiAl-based intermetallic compound is embrittled due to an increase in hardness of the matrix. If the niobium content is more than 10.0 atom %, the volume fraction Vf of brittle intermetallic compound phase is increased, thereby bringing about a reduction in ambient temperature ductility of the TiAl-based intermetallic compound. Further, if the boron content is more than 2.2 atom %, a coarse B-based intermetallic compound is precipitated, resulting in a reduced ambient temperature ductility of the TiAl-based intermetallic compound.

What is claimed is:

1. A high strength and high ductility TiAl-based intermetallic compound consisting essentially of a content of aluminum (Al) in a range represented by 42.0 atom % ≦Al≦50.0 atom %, a content of vanadium (V) in a range represented by 1.0 atom %≦V≦3.0 atom %, a content of niobium (Nb) in a range represented by 1.0 atom %≦Nb≦10.0 atom %, a content of boron (B) in a range represented by 0.03 atom %≦B≦2.2 atom %, and the balance of titanium and unavoidable impurities wherein the main phase of said compound is an $Ll_0$ γ phase, and the ratio c/a between both lattice constants "a" and "c" in the crystal structure of said $Ll_0$ γ phase being in a range represented by c/a≦1.015.

2. A high strength and high ductility TiAl-based intermetallic compound according to claim 1, wherein the relationship c/a between both lattice constants is further defined as being greater than 1.0.

3. A high strength and high ductility TiAl-based intermetallic compound according to claim 1, wherein the $Ll_0$ γ phase is present in a volume fraction percent equal to or greater than 80%.

* * * * *